US006068222A

United States Patent [19]

Stangeland

[11] Patent Number: 6,068,222

[45] Date of Patent: May 30, 2000

[54] IRON RETAINING DEVICE WITH UPSTANDING SUPPORTS RELEASABLY ATTACHED TO BASE MEMBERS ON A PLATE

[76] Inventor: Paul C. Stangeland, 3602 Lohmer La., Encinitas, Calif. 92024

[21] Appl. No.: 09/126,656

[22] Filed: Jul. 31, 1998

[51] Int. Cl.[7] ..... D06F 79/02; A47E 1/10; A47F 5/00

[52] U.S. Cl. ..... 248/117.7; 248/315.4; 248/298.1

[58] Field of Search ..... 248/117.1, 117.2, 248/117.6, 117.7, 298.1, 315.4

[56] References Cited

U.S. PATENT DOCUMENTS

| | | | |
|---|---|---|---|
| 1,116,004 | 11/1914 | Ayer | 248/117.5 |
| 1,921,038 | 8/1933 | Payne . | |
| 2,191,649 | 2/1940 | Gey . | |
| 2,285,747 | 6/1942 | Smith . | |
| 2,439,438 | 4/1948 | Thomson . | |
| 2,448,227 | 8/1948 | McCan . | |
| 2,456,987 | 12/1948 | Perkins . | |
| 2,466,825 | 4/1949 | Rollman . | |
| 2,473,731 | 9/1949 | Shepard, Sr. | 248/117.2 |
| 2,517,953 | 8/1950 | Winnikka | 248/117.7 |
| 2,528,846 | 11/1950 | Sitnick et al. . | |
| 2,791,390 | 5/1957 | Grommons . | |
| 3,027,129 | 3/1962 | Sorlie . | |
| 3,052,439 | 9/1962 | Marx, Sr. . | |
| 3,127,141 | 3/1964 | Elliston | 248/117.6 |
| 3,173,640 | 3/1965 | Brown et al. . | |
| 3,370,816 | 2/1968 | Michaud . | |
| 3,477,672 | 11/1969 | Agrusa . | |
| 4,458,874 | 7/1984 | Rabas et al. | 248/670 |
| 4,657,213 | 4/1987 | Hartlage | 248/117.7 |

FOREIGN PATENT DOCUMENTS

| | | | |
|---|---|---|---|
| 1283963 | 1/1962 | France | 248/117.6 |

*Primary Examiner*—Ramon O. Ramirez
*Assistant Examiner*—Walter Landry
*Attorney, Agent, or Firm*—William Patrick Waters

[57] ABSTRACT

A device for retaining and restraining hot irons. The device includes a plate and a pair of spaced and opposed upstanding iron supports movably attached to the plate top surface. Each one of the supports includes a base and a pair of spaced leg members removably attached to the base. Each base is movable along a slot formed in the plate to permit varying the distance between the opposed upstanding iron supports, thereby providing a capability for retaining and restraining irons having a variety of sole plate widths. In a preferred embodiment, the leg members are pivotally attached to the base so as to be erected for use and folded against the plate for storing or packaging during non-use.

25 Claims, 2 Drawing Sheets

IRON RETAINING DEVICE WITH UPSTANDING SUPPORTS RELEASABLY ATTACHED TO BASE MEMBERS ON A PLATE

FIELD OF THE INVENTION

The present invention relates generally to devices for retaining and restraining flat irons and, more particularly, to devices for removably retaining and restraining hot irons, during times of non-use in the ironing process.

BACKGROUND OF THE INVENTION

Ironing of clothing is sometimes a challenging task requiring the exercise of motor skills. Typically, the workpiece, or garment to be ironed, is placed on top of an ironing board having a high center of gravity and easily knocked over. As a result, when one is ironing a garment on a conventional ironing board, it is necessary to manipulate the garment into a suitable position while avoiding knocking the board over. The problem is exacerbated when the user must simultaneously control a hot iron so that it does not fall from the ironing board, nor burn the user, during the garment manipulation process.

Conventional irons use steam to remove wrinkles from cloth and the conventional steam iron is comprised of an interior vessel in which water is contained and heated to produce the steam. Because the vessel is often located nearer the tip of the iron, away from the heel, it is generally advisable to position the iron, when not in use, with the tip pointed up. In times of non-use, the iron is preferably stored in an upright position, thereby minimizing the likelihood of scratching the sole plate and permitting cooling without risk of damage to it.

Conventional irons are designed to have a relatively flat heel so that, in a rest position, the iron is retained by the heel. When it is so positioned on an ironing board, however, it becomes precarious since even a slight jar of the ironing board, or an inadvertent pull on the power cord, will tip the iron over with a possibility of damage to the iron or to nearby structures, or injury to the user. If the iron falls onto the ironing board surface, contact with the hot sole plate can result in burned fabric or a fire hazard.

As a rule, the user is aware of the problems associated with a hot, unstable iron and takes care to place it centrally on the ironing board, when it is not in use, near the center of the board's short axis and out of the way of the workpiece.

Iron manufacturers acknowledge the problems of hot iron instability and, in some cases, offer improved designs in an attempt to alleviate the tipping problem. An example is an enlarged heel intended to improve stability. However, ergometric considerations of the iron's intended function limit the manufacturer's ability to change the design to produce a non-tipping iron. As an option, some manufacturers offer expensive "shut off" features which provide for an interruption of electrical power in cases where the iron is tipped off the ironing board. While such an option has some utility, it still does not address the physical hazards caused by a hot falling iron, nor the aforementioned difficulties associated with an unstable iron on an easily jarred ironing board surface.

In view of the foregoing, it would be highly desirable to have a hot iron retaining and restraining device capable of holding a hot iron safely and securely, in an upright position, so that the iron would be out of the way of garment placement. Ideally such a device would prevent tipping or dislodgment of the iron even when the ironing board is jarred.

The problem of retaining a hot iron during periods of non-use is an old one and a long felt need exists for its solution. Attempts to solve the problem have been made. In this regard, reference may be made to U.S. Pat. Nos.: 1,828,249; 1,921,038; 2,191,649; 2,285,747; 2,456,987; 2,439,438; 2,528,846; 3,027,129; 3,052,439 and 4,458,874.

The mentioned patents fail to disclose an iron retaining device suitable for holding a hot iron in a desired upright position. In view of the prior art, it may be concluded that no single device, nor combination of features in conventional devices, would result in an iron retaining device capable of retaining modern irons in a secure, convenient and vertically free standing position. Thus, a need exists for such a device.

Preferably, the device would be used conveniently on the surface of a functioning ironing board or be installed in proximity to the ironing board. In addition, it would be simple in construction and composed of readily available materials.

In addition to a general lack of suitability of conventional devices, a significant detriment to market acceptance of prior art devices has been their complexity and bulk. These factors increase difficulty and expense in packaging, shipping, storing and displaying the devices. In view of this, it would be advantageous to have an iron retaining and restraining device which could be conveniently packaged, shipped, stored and displayed.

DISCLOSURE OF THE INVENTION

It is an object of the present invention to provide a free standing iron retaining and restraining device for retaining vertically a hot iron wherein the device can be accessed conveniently to install the iron and to withdraw it therefrom.

It is another object of the present invention to provide an iron retaining and restraining device which is composed of readily available material and is inexpensive to make.

It is yet another object of the present invention to provide an iron retaining and restraining device which can be effectively and efficiently utilized to retain removably a hot iron on an ironing board during the ironing process.

It is a further object of the present invention to provide an iron retaining and restraining device which is easily adapted to irons of a variety of sizes and construction and readily attachable to an ironing board surface.

It is a still further object of the present invention to provide an iron retaining and restraining device in which a hot iron can cool with reduced risk of damage to the sole plate and which can be used to store the iron securely when it is not in use.

It is an even still further object of the present invention to provide an iron retaining and restraining device which is small in size and light in weight so as to be conveniently packaged, shipped and stored.

It is an additional object of the present invention to provide an iron retaining and restraining device which can be collapsed conveniently for storing and packaging, without requiring disassembly of the device.

Briefly, the above and further objects of the present invention are realized by providing a device for retaining and restraining hot irons. The device includes a plate and a pair of spaced and opposed upstanding iron supports movably attached to the plate top surface. Each one of the supports includes a base and a pair of spaced leg members removably attached to the base. Each base is movable along a slot formed in the plate to permit varying the distance between the opposed upstanding iron supports, thereby providing a capability for retaining and restraining irons having a variety of sole plate widths. In a preferred embodiment, the leg members are pivotally attached to the base so as to be erected for use and folded against the plate for storing or packaging during non-use.

The present invention affords several advantages, a principal one being that the device can be readily utilized on or near an ironing board so that the user can install the iron, and remove it, in a convenient manner. In addition, the present invention includes an ajustability capability whereby the spaced and opposed upstanding supports may be moved relative to one another to accommodate irons having a broad spectrum of iron sole widths. Still further, the invention is comprised of few parts and is constructed of readily available, inexpensive materials.

In addition to the above mentioned advantages, the present invention prevents the iron from rotating on any of its axes and upstanding iron supports trap the hot iron by enclosing its sole plate and enough of the body of the iron to prevent it from escaping in any horizontal direction. Typically, portions of the iron sole plate and body remain outside, to either side of, a quadrilateral described by the two pairs of leg members and their corresponding bases. Thus, the iron is prevented from passing forward of the front leg members while only a portion of the iron's handle and body protrude toward the rear. In this manner, the iron cannot pass through any spaces between the leg members and can be removed from the device only by being lifted out.

BRIEF DESCRIPTION OF DRAWINGS

The above mentioned and other objects and features of this invention and the manner of attaining them will become apparent and the invention itself will be best understood by reference to the following description of the embodiment of the invention in conjunction with the accompanying drawings, wherein.

BEST MODE FOR CARRYING OUT THE INVENTION

Figure 2:
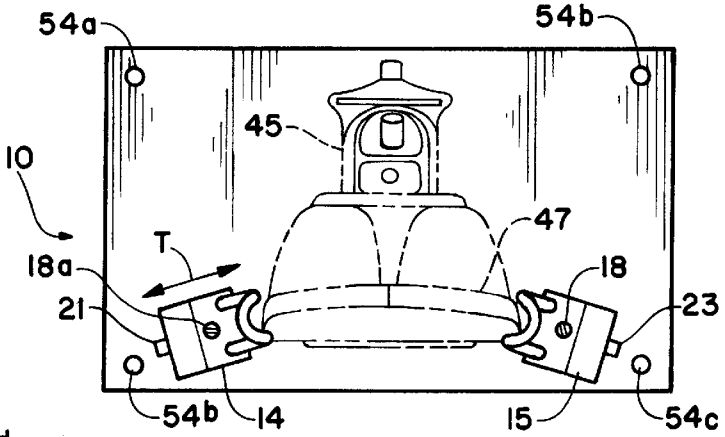
FIG. 2 is a top plan view of the iron retaining and restraining device of the present invention showing an iron retained in the device, the iron being shown partially in phantom.

Referring now to the drawings and more particularly, to FIGS. 1–4 thereof, there is shown a flat iron retaining and restraining device 10 which is constructed according to the present invention. The device 10 includes a generally rectangular plate 12 having a front edge 18 and a back edge 19. References herein to relative terms such as "left" and "right" are to be considered as if one were looking at the plate 12 from the back edge 19 and toward the front edge 18. As used herein, "medial" or "medially" are intended to mean toward or in the direction of an imaginary plate centerline disposed between the plate front edge 18 and the plate back edge 19. "Lateral" or "laterally" means toward or in a direction away from plate centerline.

The plate 12 is constructed of suitable material with aluminum being preferred. The plate may be strapped to an ironing board by conventional strap means (not shown) or it may be fixed to a substrate (not shown) in a conventional manner by use of screws or bolts through openings 54*a* through 54*d* formed in the plate 12. A slot 21 and a slot 23 are formed in the plate 12 with the slot 21 located on the left side of the plate 12, near the front edge 18 while the slot 23 is located on the right side of the plate 12, near the front edge 18. Each slot includes a lateral end and a medial end wherein the lateral end, in each slot, is closer than the respective medial end to the plate front edge 18. The role of the slots 21 and 23 in adjusting components of the device 10 to accommodate a variety of different irons will be more fully discussed below.

Figure 4:
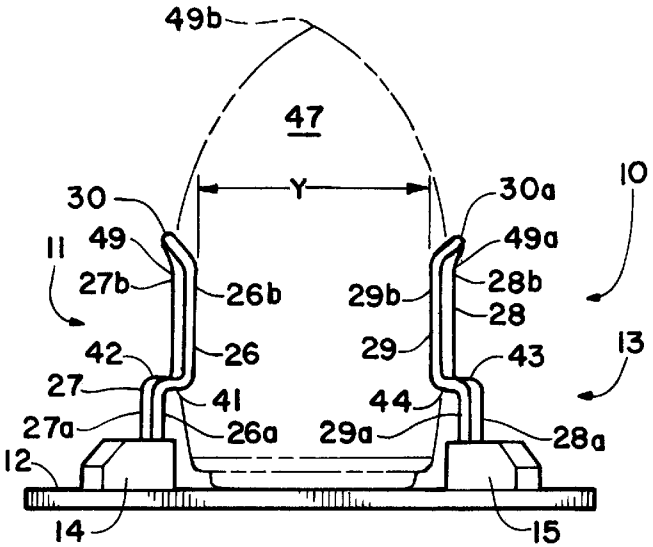
FIG. 4 is a front elevational view of the iron retaining and restraining device of the present invention, showing an iron in phantom removably retained in a vertical freestanding position in the device.
Figure 1:
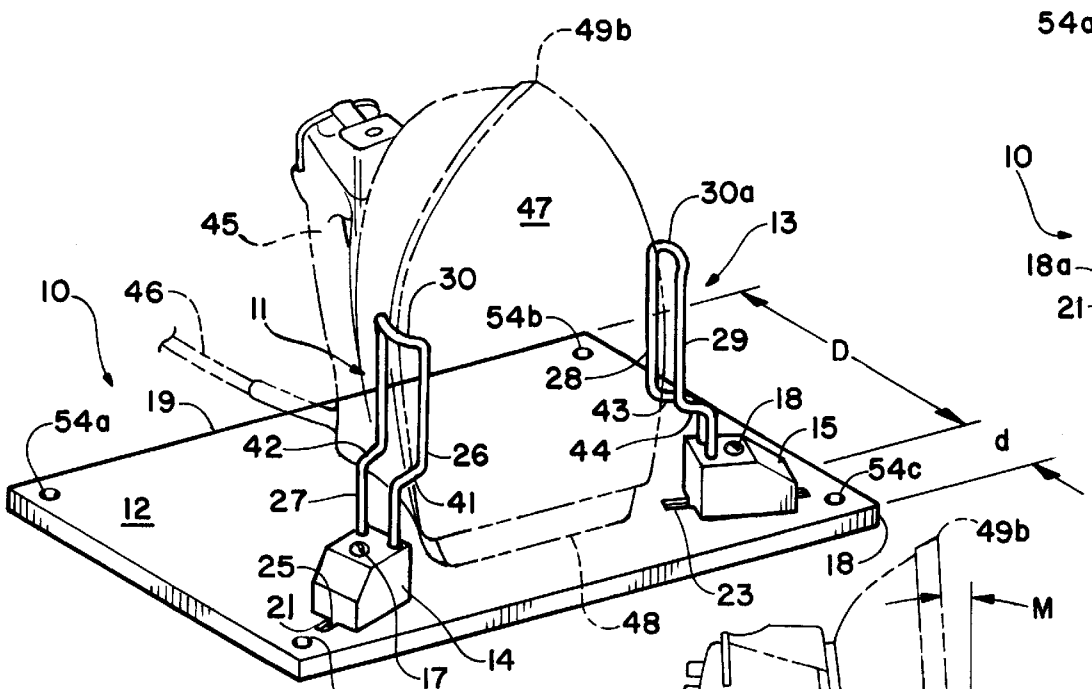
FIG. 1 is a perspective view of the iron retaining and restraining device of the present invention.

A pair of identical spaced and opposed upstanding iron supports 11 and 13 is disposed on the top surface of the plate 12 with the support 11 located near the left side of the plate 12 and the support 13 located near the right side thereof. The upstanding support 11 includes a base 14 having a pair of upstanding spaced leg members 26 and 27 removably attached to it. As best shown in FIG. 4, the leg member 26 includes a lower portion 26*a* integrally joined by a shoulder 41 to an upper portion 26*b* and the leg member 27 includes a lower portion 27*a* integrally joined by a shoulder 42 to an upper portion 27*b*. The leg member upper portions 26*b* and 27*b* are integrally joined by an laterally projecting splayed arch 30.

In a similar manner, the upstanding support 13 includes a base 15 having a pair of upstanding spaced leg members 28 and 29 removably attached to it. As best shown in FIG. 4, the leg member 28 includes a lower portion 28*a* integrally joined by a shoulder 43 to an upper portion 28*b* and the leg member 29 includes a lower portion 29*a* integrally joined by a shoulder 44 to an upper portion 29*b*. The leg member upper portions 28*b* and 29*b* are integrally joined by a laterally projecting splayed arch 30*a*.

The opposed upstanding supports 11 and 13 are removably attached at the top surface of the plate 12 by conventional fastening methods. For example, bolts 17 and 18 are utilized to hold the supports 11 and 13, respectively, against the plate 12. The bolts 17 and 18 pass through the slots 21 and 23, respectively, and permit movement, generally medially or laterally, of the supports 11 and 13, respectively. In this manner, adjustment of the distance between the upstanding supports 11 and 13 can be readily accomplished, in order to accommodate irons having differing widths.

The slots 21 and 23, as measured at a point near the front ends thereof, are located at a distance d from the front edge 18 and at a distance D from the back edge 19 of the plate 12 wherein the ratio d/D is about 1 to 3. Since conventional irons tend to tip forward upon being jarred, by retaining and restraining an iron well forward on the plate 12, the likelihood of iron tipping is substantially reduced.

Since the dimensions of modern irons vary considerably and, to insure that the iron retaining and restraining device 10 is suitable for a broad spectrum of irons, the device 10 includes means for adjusting a distance Y (FIG. 4) between the upstanding iron supports 11 and 13. This is accomplished by moving the opposed upstanding supports closer to one another, or farther apart along the slots 21 and 23 respectively. Stability of the support 11 is enhanced by provision of a ridge 25 which extends from the bottom surface of the base 14 to engage the slot 21 for slideable movement therein. An identical ridge on the base 15 engages the slot 23. The ridges, such as the ridge 25, not only lend stability to the upstanding supports 11 and 13, they aid in holding the supports in a desired location on the plate 12. Thus, when it is necessary to adjust the separation between the upstanding supports 11 and 13, the user simply loosens one or both of the base attachment means, such as the bolts 17 and 18, and moves one or more of the bases 14 and 15 until a desired distance Y is obtained. At this point, the attachment means is tightened to secure the opposed upstanding supports 11 and 13 in a desired spatial relationship.

Before discussing further the function of the retaining and restraining device 10, it will be helpful to consider a modern flat iron, such as the iron 45. The iron 45 includes a body 45*a*, an electrical power cord 46, a sole plate 47, a heel 48 and a tip 49*b*. While the dimensions of the sole plate 47 can vary from one model of iron to another, the sole plate typically is about ¼ to ½ inch thick and about 8 to 9 inches in length. The width of a typical sole plate 47 is about 4 to 4½ inches at its widest point and the sole plate 47 has tapering sides 49 and 49*a* which, starting at mid distance between heel and tip, curve gradually meet at the sole plate tip 49*b*.

It is recognized that the dimensions of conventional irons will differ from those set forth herein. For example, modern flat iron sole plates are generally thinner, and sometimes different in width as contrasted with older versions. As a general rule, differences in sole plate width and thickness present significant challenges in prior art iron retaining devices, rendering the devices useless for certain iron types. If for example, the retaining device is too narrow, the iron sole plate will not fit and, if it is too wide, the iron will not be adequately retained and will be in danger of being tipped out of the retaining device.

In contrast to prior devices, the iron retaining and restraining device 10 is adapted for releasable retention of a broad variety of irons having varying lengths and sole plate widths. In this regard, the ability of the device 10 to retain and restrain an iron is derived from the capability of adjusting the separation between the opposed upstanding iron supports 11 and 13 as described above. In addition, the spaced leg members play an important role, as discussed below.

Figure 3:
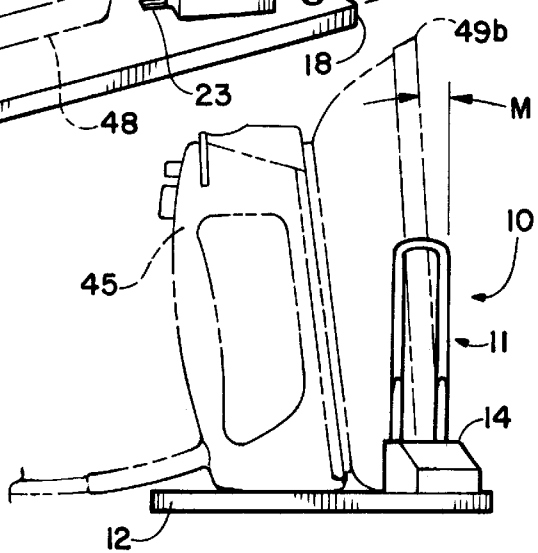
FIG. 3 is a side elevational view of the iron retaining and restraining device of the present invention showing an iron in phantom removably retained in a vertical freestanding position in the device.

In use of the device 10, it is preferable that the upstanding supports 11 and 13 be spaced so as to hold the iron sole plate 47 releasably between the spaced leg members 26 and 27 of the support 11 and between the spaced leg members 28 and 29 of the support 13. In this regard, the technique of retaining and restraining the iron 45 is clearly shown in FIG. 2 where the sole plate 47 is retained and restrained between the upstanding supports 11 and 13. With the iron 45 so retained, the heel 48 of the iron rests securely on the plate 12. As shown in FIG. 3, the sole plate 47 may move a short distance within the device 10, as depicted by an arrow M, but the iron 45 will not and cannot be rotated so as to fall from the device 10. With reference to FIG. 4, it will be noted that the sole plate edges 49 and 49*a* extend laterally outside of a plain formed respectively by the leg members 26 and 27 of the upstanding support 11 and an opposite plain formed by the leg members 28 and 29 of the upstanding support 13. So retained and restrained, the iron 45 is incapable of rotating about its axes to escape from the device 10.

The laterally splayed arches 30 and 30*a* enable the user to insert the iron 45 easily into the device 10 by simply moving the iron downwardly until the iron heel 48 rests on the plate 12. Conversely, the iron 45 can be easily removed by the user by simply raising it out of the device 10

In summary, the iron 45 will be securely held within the iron retaining and restraining device 10, as long as the sole plate edges or sides 49 and 49*a* extend laterally through the plains formed by the leg members 26 and 27 and the leg members 28 and 29, respectively. Thus, it is not necessary for the upstanding iron supports 11 and 13 to be positioned so as to hold the iron 45 tightly. On the contrary, some looseness is acceptable without diminishing the security of the retained iron. This factor makes convenient and effective use of the device 10 possible for a broad spectrum of irons.

Figure 5:
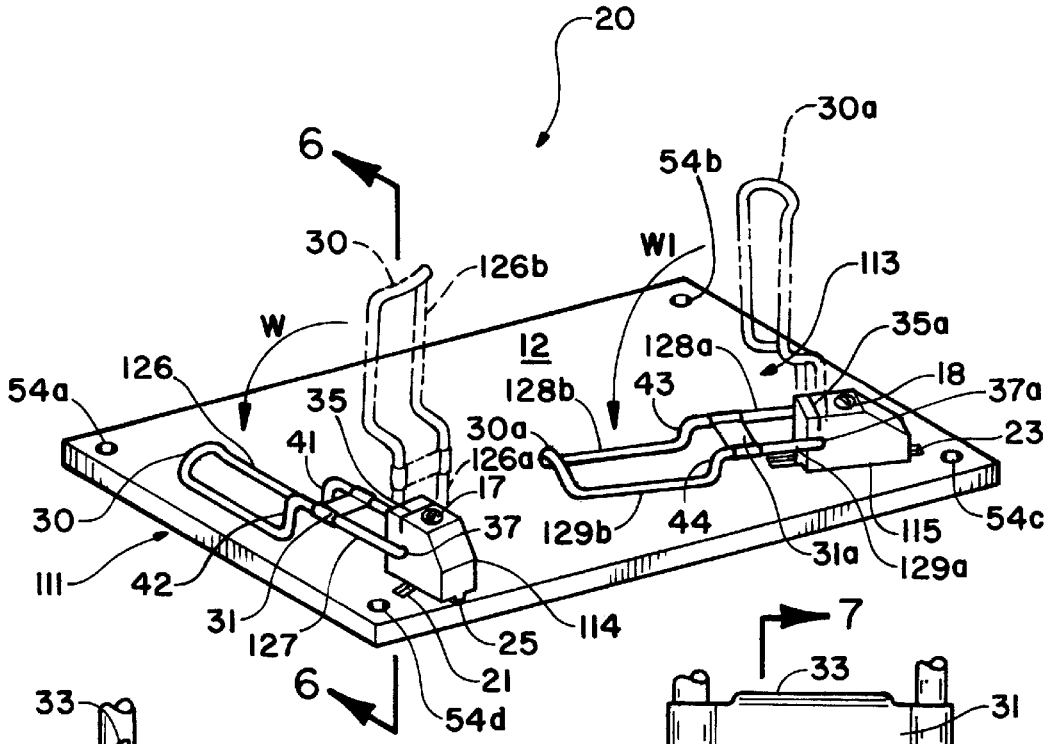
FIG. 5 is a perspective view of another embodiment of the iron retaining and restraining device of the present invention.
Figure 7:
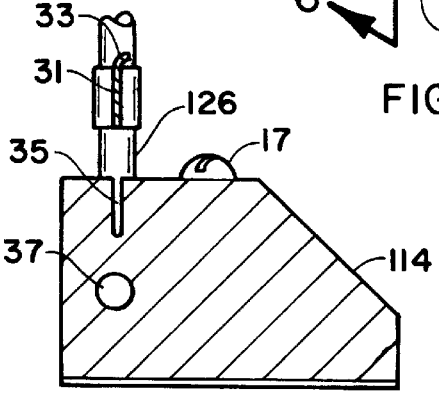
FIG. 7 is a sectional view taken along the line 7—7 of FIG. 6.
Figure 6:
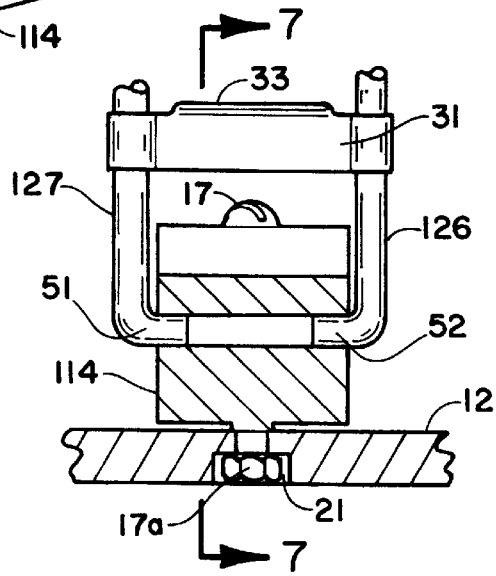
FIG. 6 is a sectional view taken along the line 6—6 of FIG. 5.

Referring now to FIGS. 5 through 7, there is shown a presently preferred embodiment of an iron retaining and restraining device 20. In these figures, identical numerals relate to elements identical in structure and function to their respective counterparts in the device 10, as shown in FIGS. 1 through 4. The device 20 functions in a manner identical to the device 10 with all iron retaining and restraining characteristics being the same. However, the device 20 includes a capability for collapsing the opposed upstanding supports against the plate 12, without any necessity of disassembly. Thus, the device 20 is advantageously adapted for cost effective packaging, shipping, storage and display. In this regard, its commercial value is enhanced and it benefits not only the ultimate consumer but also those in the marketing chain from manufacturer to retailer.

In a manner similar to that of the device 10, a pair of identical spaced and opposed upstanding iron supports 111 and 13 is disposed on the top surface of the plate 12 with the support 111 located near the left side of the plate 12 and the support 113 located near the right side thereof. The upstanding support 111 includes a base 114 having a pair of upstanding spaced leg members 126 and 27 pivotally attached thereto. The leg member 126 includes a lower portion 126*a* integrally joined by a shoulder 41 to an upper portion 126*b* and the leg member 127 includes a lower portion 127*a* integrally joined by a shoulder 42 to an upper portion 127*b*. The leg member upper portions 126*b* and 127*b* are integrally joined by an laterally projecting splayed arch 30. The lower portion 126*a* includes a foot member 52 extending at generally a right angle to the long axis of the portion 126*a* while, in a similar manner, the lower portion 127*a* includes a foot member 51. Openings 37 and 37*a* in the base 114 receive, respectively, the foot members 52 and 51 and retain the foot members for pivotal movement therein.

In a similar manner, the upstanding support 113 includes a base 115 having a pair of upstanding spaced and opposed leg members 128 and 129 pivotally attached to it. The leg member 128 a lower portion 128*a* integrally joined by a shoulder 43 to an upper portion 128*b* and the leg member 129 includes a lower portion 129*a* integrally joined by a shoulder 44 to an upper portion 127*b*. The leg member upper portions 128*b* and 129*b* are integrally joined by an laterally projecting splayed arch 30*a*. The lower portions 128*a* and 129*a* also include respective foot members received in the base 115 for pivotal movement as set forth above in the case of the support 111.

The novel pivoting or rotating capability of the opposed upstanding iron supports 111 and 113 enable the supports to be rotated downwardly, in the direction indicated by the arrows W and W1, so that the supports rest against the top surface of the plate 12. As a result, the device 20 can be packaged and stored in a convenient manner, without any necessity of disassembly of its components.

The opposed upstanding supports 111 and 113 are removably attached at the top surface of the plate 12 by conventional fastening methods. For example, bolts 17 and 18 are utilized to hold the supports 111 and 113, respectively, against the plate 12. The bolts 17 and 18 pass through the slots 21 and 23, respectively, and permit movement of the supports 111 and 113, respectively, for adjustment of the distance between them in order to accommodate irons having differing widths. As shown in FIG. 6, a nut 17*a* is utilized in both embodiments of the invention to engage the bolt 17.

It is necessary, during use of the device 20 to insure that the upstanding supports 111 and 113 are held in an erected non rotating condition. In the case of the support 111, this is accomplished by the provision of a guillotine or blade 31 which is attached to the leg member lower portions 126*a* and 127*a*. The guillotine 31 is disposed between the leg lower portion and is adapted for slideable movement therealong. A guillotine receiving groove 35 is formed in the top surface of the base 114. Prior to use of the device 20 and in order to erect the support 111, the user simply slides the guillotine 31 downwardly on the leg portions 126*a* and 127*a* until the guillotine 31 is received and held in the groove 35. In this condition, the support 111 is fixed in an upstanding position.

The support 113, is moved and fixed in an upstanding position in an identical manner. A guillotine or blade 31*a* is attached to the leg member lower portions 128*a* and 129*a* and guillotine receiving groove 35*a* is formed in the top surface of the base 115. Here again, prior to use of the device 20 and in order to erect the support 113, the user slides the guillotine 31*a* downwardly on the leg portions 128*a* and 129*a* until the guillotine 31*a* is received and held in the groove 35*a* to hold the support 113 in an upstanding position.

During non-use of the device 20, and in preparation for storage or packaging for example, the guillotines 31 and 31*a* are raised from their respective groove 35 and 35*a* respectively, and the upstanding supports are folded against the top surface of the plate 12. A fingernail engageable lip 33 is formed on the upper surface of the guillotine 31 to aid the user in raising the guillotine from the groove 35 and a similar lip is formed on the upper surface of the guillotine 31*a*.

Figure 8:
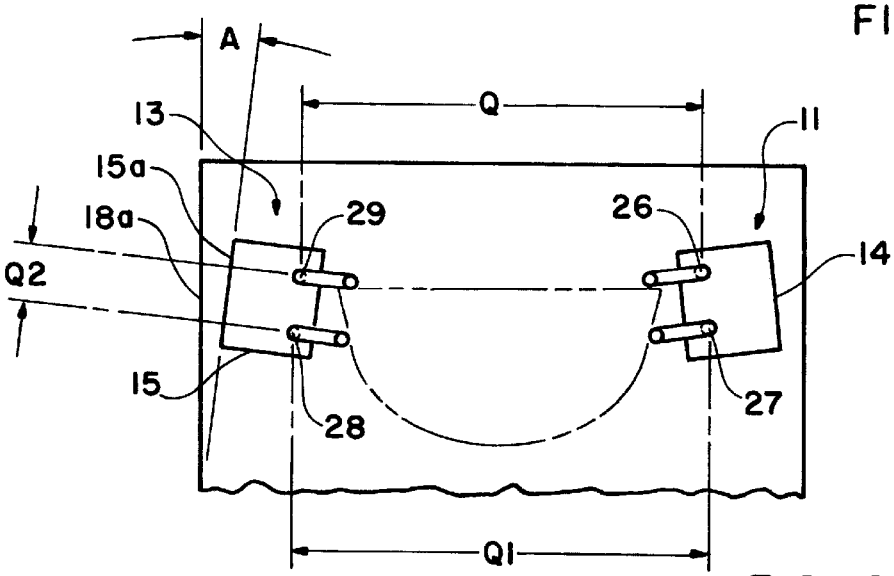
FIG. 8 is a diagrammatic top plan depiction of the spatial relationships among some of the components of the present invention.

Referring now to FIG. 8, there is therein shown a diagrammatic top plan view depicting the relationships among the upstanding iron supports 11 and 13 and of the bases 14 and 15 in the device 10. An iron is shown in phantom. While the figure shows the elements of the device 10 it will be understood that the spatial representations shown in FIG. 8 are identical for both the device 10 and the device 20. The bases 14 and 15, releasably attached to the plate 12 are angled with respect to the sides of the plate 12 so as to form an angle A, in the case of the base 15, of about 5 degrees between a base side 15*a* and a plate side 18*b*.

It will be noted that a distance Q between the leg members 26 and 29 is less than a distance Q1 between the leg members 27 and 28. Preferably, the distances Q and Q1 are each adjustable within a range of about 3 inches to about 5 inches. A distance Q2, between the leg members 26 and 27 on the one hand and 28 and 29, on the other, is preferably about 1.25 inches.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

It will be evident that there are additional embodiments and applications which are not disclosed in the detailed description but which clearly fall within the scope and spirit of the present invention. The specification is, therefore, intended not to be limiting, and the scope of the invention is to be limited only by the following claims.

What is claimed is:

1. A device for retaining an iron comprising:

a plate;

a pair of spaced upstanding iron supports at, least one of said pair of upstanding iron supports being movably attached to the top surface of said plate, each one of said pair of upstanding iron supports including a base and a pair of spaced leg members, each one of said pair of leg members being releasably attached to said base;

means for adjusting the distance between one of said pair of upstanding iron supports and another one of said pair of upstanding iron supports, wherein said distance adjusting means includes a slot formed in said plate; and means, partially disposed in said slot, for releasably attaching at least one of said bases to said plate.

2. The iron retaining device according to claim 1 wherein said plate has a front edge and a back edge and said slot includes a first end and a second end, wherein said second end is located nearer than said first end to said plate front edge.

3. The iron retaining device according to claim 2 wherein said upstanding iron supports are attached to said plate at a location closer to said plate front edge than to said plate back edge.

4. The iron retaining device according to claim 1 wherein at one of said bases includes a bottom surface having a ridge extending therefrom wherein said ridge is received in said slot for positioning therealong for adjusting the distance between said upstanding iron supports.

5. The iron retaining device according to claim 4 wherein the upper portions of the leg members of each of said pair of leg members includes a laterally splayed arch integrally connected to said leg member upper portions.

6. The iron retaining device according to claim 1 wherein each one of said pair of leg members includes an upper portion, a lower portion and a shoulder portion, said shoulder portion being disposed between, and integrally connected to, said upper portion.

7. The iron retaining device according to claim 1 wherein one of each of said pairs of leg members is disposed closer to said plate front end than the other one of each of said pairs of leg members.

8. The iron retaining device according to claim 1 wherein said means for releasably attaching includes a bolt and a nut.

9. The iron retaining device according to claim 1 wherein distance between one of said pair of upstanding iron supports and another one of said pair of upstanding iron supports is between about 3 inches and about 5 inches.

10. The iron retaining device according to claim 1 wherein said means for releasably attaching includes an opening formed in at least one of said legs.

11. The iron retaining device according to claim 1 wherein said leg members are spaced about 1.25 inches apart.

12. A device for retaining an iron comprising:

a plate;

a pair of spaced upstanding iron supports, at least one of said pair of upstanding iron supports being movably attached to the top surface of said plate, each one of said pair of upstanding iron supports including a base and a pair of spaced leg members, each one of said pair of leg members being pivotally attached to said base;

means for adjusting the distance between one of said pair of upstanding iron supports and another one of said pair of upstanding iron supports wherein said distance adjusting means includes a slot formed in said plate and means, partially disposed in said slot, for releasably attaching at least one of said bases to said plate.

13. The iron retaining device according to claim 12 wherein said plate has a front edge and a back edge and said slot includes a first end and a second end, wherein said second end is located nearer than said first end to said plate front edge.

14. The iron retaining device according to claim 12 wherein at least one of said bases includes a bottom surface having a ridge extending therefrom wherein said ridge is received in said slot for positioning therealong for adjusting the distance between said upstanding iron supports.

15. The iron retaining device according to claim 12 wherein each one of said pair of leg members includes an upper portion, a lower portion and a shoulder portion, said shoulder portion being disposed between, and integrally connected to, said upper portion.

16. The iron retaining device according to claim 15 wherein the upper portions of the leg members of each of said pair of leg members includes a laterally splayed arch integrally connected to said leg member upper portions.

17. The iron retaining device according to claim 12 wherein one of each of said pairs of leg members is disposed closer to said plate front side than the other one of each of said pairs of leg members.

18. The iron retaining device according to claim 12 wherein said means for releasably attaching includes a bolt and a nut.

19. The iron retaining device according to claim 12 wherein said means for releasably attaching includes an opening formed in at least one of said bases.

20. The iron retaining device according to claim 12 wherein said leg members are spaced about 1.25 inches apart.

21. The iron retaining device according to claim 12 wherein distance between one of said pair of upstanding iron supports and another one of said pair of upstanding iron supports is between about 3 inches and about 5 inches.

22. The iron retaining device according to claim 12 wherein said upstanding iron supports are attached to said plate at a location closer to said plate front edge than to said plate back edge.

23. The iron retaining device according to claim 12 wherein each one of said leg members includes a foot member and each one of said bases includes an opening for receipt of a foot member for rotational movement therewithin.

24. The iron retaining device according to claim 12 wherein each of one said upstanding iron supports includes a pair of spaced leg members having a blade disposed between said leg members and slideably attached to each of said leg members, each one of said iron supports further including a base having a groove formed therein for receipt of said blade.

25. The iron retaining device according to claim 24 wherein said blade includes a finger engageable lip for helping in raising said blade from said groove.

* * * * *